US005588537A

United States Patent [19]

Hagopian

[11] Patent Number: 5,588,537

[45] Date of Patent: Dec. 31, 1996

[54] MERCHANDISE DISPLAY SYSTEM

[75] Inventor: Gerald M. Hagopian, Oak Creek, Wis.

[73] Assignee: KCS Industries, Inc., Milwaukee, Wis.

[21] Appl. No.: 305,039

[22] Filed: Sep. 13, 1994

[51] Int. Cl.[6] ..... E05B 73/00

[52] U.S. Cl. ..... 211/4; 211/169

[58] Field of Search ..... 24/4, 7, 40, 94.5, 24/169, 96; 248/553, 551, 221.11

[56] References Cited

U.S. PATENT DOCUMENTS

| | | | |
|---|---|---|---|
| 2,740,528 | 4/1956 | Kaiser | 211/4 |
| 3,299,839 | 1/1967 | Nordbak | 248/221.11 |
| 3,760,952 | 9/1973 | White | 211/4 |
| 3,785,499 | 1/1974 | Gedye | 211/4 |
| 4,387,872 | 6/1983 | Hogue | 248/221.11 |

FOREIGN PATENT DOCUMENTS

| | | | |
|---|---|---|---|
| 1459996 | 12/1976 | United Kingdom | 211/4 |

*Primary Examiner*—Karen J. Chotkowski
*Assistant Examiner*—Gwendolyn Wrenn
*Attorney, Agent, or Firm*—Foley & Lardner

[57] ABSTRACT

A merchandise display system includes a support member and a locking bar. The support member, which may include a series of slotted rails, is adapted to receive display enclosures having an internal display space for displaying merchandise. Each display enclosure includes at least one locking tab which serves to support the enclosure on the support member and which cooperates with the locking bar to prevent removal of the enclosure from the support member when the locking bar is in a first position and to permit removal of the enclosure when the locking bar is in a second position. In a second embodiment of the display system a display rack is mounted in a frame. The display rack includes first and second spaced apart, substantially parallel side members. A plurality of separators are slidably coupled intermediate the first and second members and include retaining means, such as lips or flanges for engaging and retaining merchandise positioned between the separators.

24 Claims, 9 Drawing Sheets

MERCHANDISE DISPLAY SYSTEM

BACKGROUND OF THE INVENTION

The present invention relates generally to a merchandise display system. More particularly, the present invention relates to a system for displaying merchandise in a retail setting that allows the merchandise to be secured against pilferage, while still permitting it to be examined by potential buyers and readily removed from display when selected by a customer for purchase.

A constant challenge for retail sales establishments is the effective display of merchandise to the buying public. The system must allow customers to examine merchandise sufficiently to make a decision to buy, while protecting the merchant against pilferage. Such systems must also be relatively space-efficient to allow a merchant to display as much product as possible per unit of sales area. Where such systems rely on locking mechanisms to restrict access to the merchandise, these mechanisms must be susceptible to quick and easy opening and closing by sales personnel. Finally, the structure and operation of the system must be suitable to the product being displayed.

A number of products pose problems in this regard, particularly merchandise packaged in relatively regular enclosures such as compact discs, music cassettes and computer software. While a number of systems have been proposed or adapted for the display for sale of such products, no system has satisfactorily fulfilled the criteria mentioned above. Such products are often displayed in open-access display stands, providing little or no security against pilferage and limiting the number of titles that potential buyers can view simultaneously. In other known display systems, locking showcases are provided with openings small enough to prevent removal of merchandise, while still permitting buyers to insert their hands into the cases to handle and examine the merchandise. Such showcases are often heavy and bulky and require that the entire case be opened for organizing and restocking merchandise. In another known approach, particularly adapted to the display of regularly shaped packages such as for compact discs, music cassettes and computer software, each item of merchandise is placed in a larger plastic or paper package that can be displayed in large open bins. Where the product is packaged in a paper box, a large quantity of waste paper is generated that is simply discarded by the buyer. However, where no such packaging or display case is used, the risk of significant loss by pilferage increases.

The present invention is directed to overcoming or minimizing the drawbacks of known display techniques. In particular, the invention is directed to a display system that allows the buying public to view and examine merchandise, while offering considerable security to merchants.

SUMMARY OF THE INVENTION

In accordance with one aspect of the invention, there is provided a merchandise display system including a framework having a support member and a locking member, the support member being adapted to receive at least one locking tab or an attachment member associated with an article of merchandise for supporting the article for display on the support member. The locking member is adapted to interact with the locking tab to prevent removal of the merchandise from the support member when the locking member is in a first position with respect to the locking tab and to permit removal of the merchandise enclosure when the locking member is in a second position with respect to the locking tab.

In accordance with another aspect of the invention, a merchandise display system includes a locking section including a plurality of locking bars. The system also includes a display section including a support structure adapted to receive a plurality of removable display enclosures. The display section is coupled to the locking section and moveable with respect to the locking section between a closed position and an open position. The system further includes a plurality of display enclosures, each enclosure including an internal display space and a locking tab. The locking tab is suitably configured to cooperate with the support structure to releasably engage the display case on the support structure. In accordance with this aspect of the invention, each locking bar is adapted to cooperate with a locking tab of at least one display enclosure to prevent removal of the display enclosure when the display section is in the closed position and to permit removal of the display enclosure when the display section is in the open position.

In accordance with a further aspect of the invention, the merchandise display system includes a frame and at least one display rack mounted on the frame. The display rack has first and second side members extending in substantially parallel, spaced-apart relation. At least one separator is slidably coupled intermediate the first and second side members. The separators include retaining means for engaging and retaining merchandise positioned in the display space.

BRIEF DESCRIPTION OF THE DRAWINGS

The present invention will become more fully understood from the following detailed description, taken in conjunction with the accompanying drawings, wherein like reference numerals refer to like parts, in which.

DESCRIPTION OF THE PREFERRED EMBODIMENTS

Figure 1:
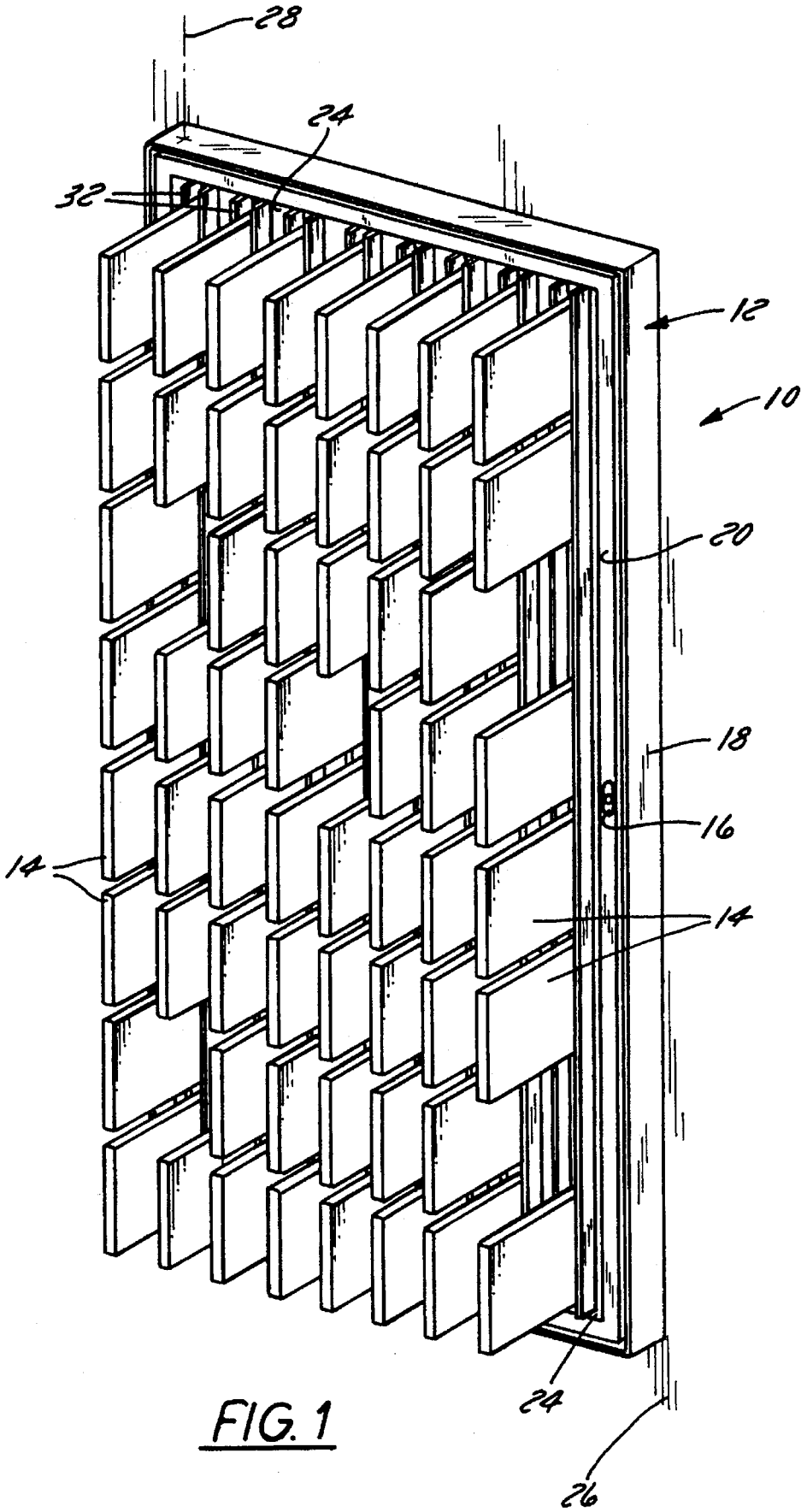
FIG. 1 is a perspective view of a first preferred embodiment of a display system in accordance with the present invention in the closed or locked position.
Figure 2:
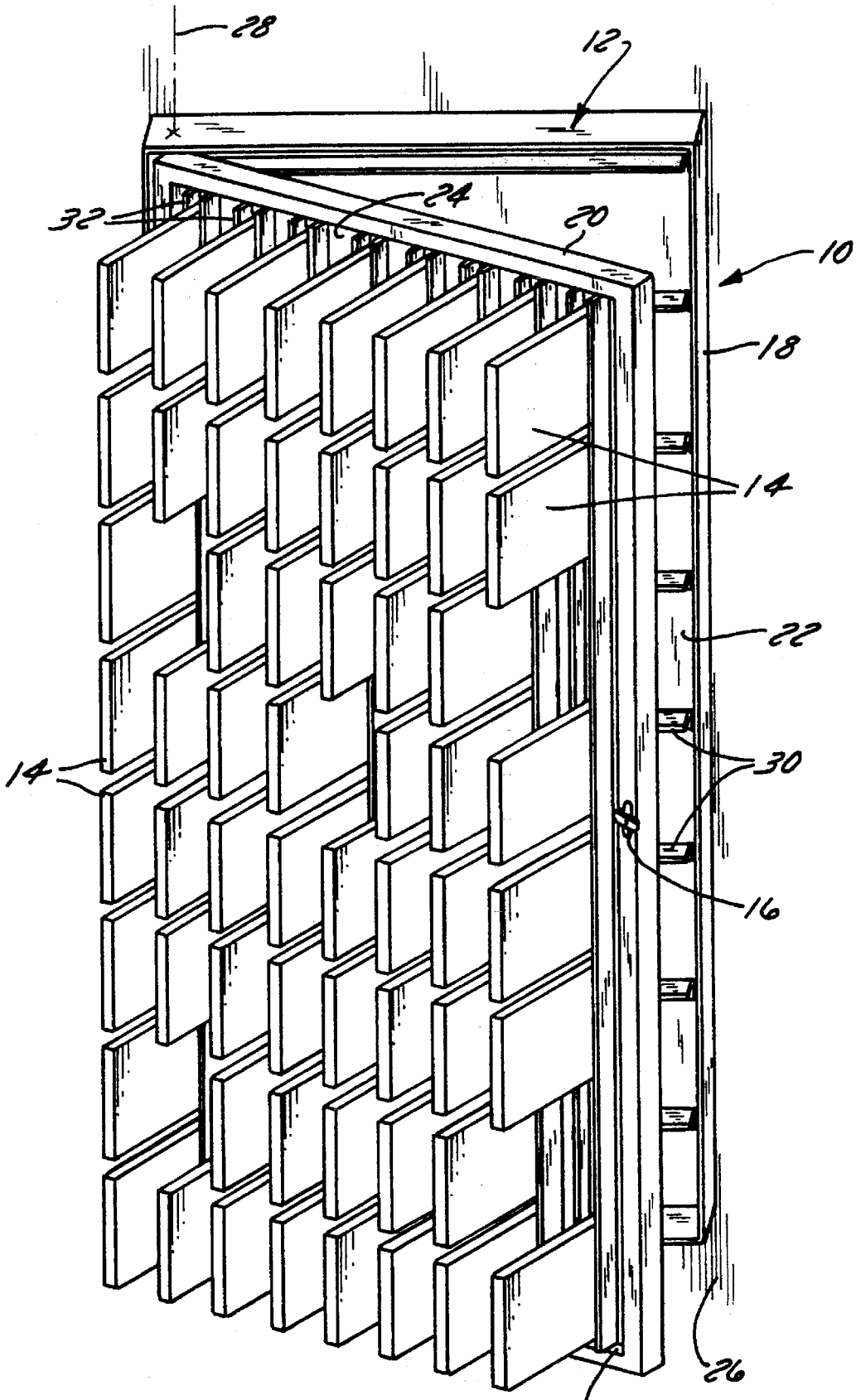
FIG. 2 is a perspective view of the display system of FIG. 1 opened for removal of merchandise.

Turning now to the drawings and referring to FIGS. 1 and 2, a display system 10 is illustrated as including a framework 12 for supporting a number of articles of merchandise, such as in display cases or enclosures 14 for displaying compact discs, computer software packages and the like. Although regularly-shaped articles and enclosures 14 are illustrated in the FIGURES, display system 10 is equally suited for displaying irregularly-shaped merchandise as well as articles of various sizes. Because enclosures 14 are secured in system 10 independently of one another, display system 10 need not be completely filled with enclosures 14 to provide security for the enclosures mounted in system 10. Display system 10 includes a lock 16 for securing the case in a closed or locked position as illustrated in FIG. 1. Framework 12 includes a stationary or fixed section 18 and a moveable section 20. In the embodiment illustrated in FIG. 2, stationary section 18 is a rectangular frame having a central aperture 22, while moveable section 20 is a similar frame surrounding a central aperture 24. Section 20 is pivotally mounted to stationary section 18 by, for instance, a conventional axle rod (not shown), and can be nested within section 18. Display system 10 is installed, such as in a retail shop, by attaching stationary section 18 to a wall or support 26 by any appropriate means, such as by bolts (not shown). Alternatively, display system 10 may be used as a free-standing unit by including suitable legs or a base (not shown) on section 18.

Display system 10 permits merchandise contained in enclosures 14 to be examined easily, prevents removal of the merchandise when the system is in a closed or locked position, and permits removal when the system is in an opened or unlocked position. In the first preferred embodiment shown in FIGS. 1 and 2, frame section 20 is mounted pivotally on stationary section 18 and is moveable about an axis 28 between a closed or locked position (FIG. 1) and an open or unlocked position (FIG. 2). A series of locking members or bars 30 is rigidly mounted in stationary section 18, and a series of support members or rails 32 is mounted within frame section 20 to support merchandise enclosures 14. Locking bars 30 cooperate with merchandise attachment members, such as enclosures 14 to prevent removal of merchandise from support rails 32 when frame section 20 is in the closed position.

Figure 3:
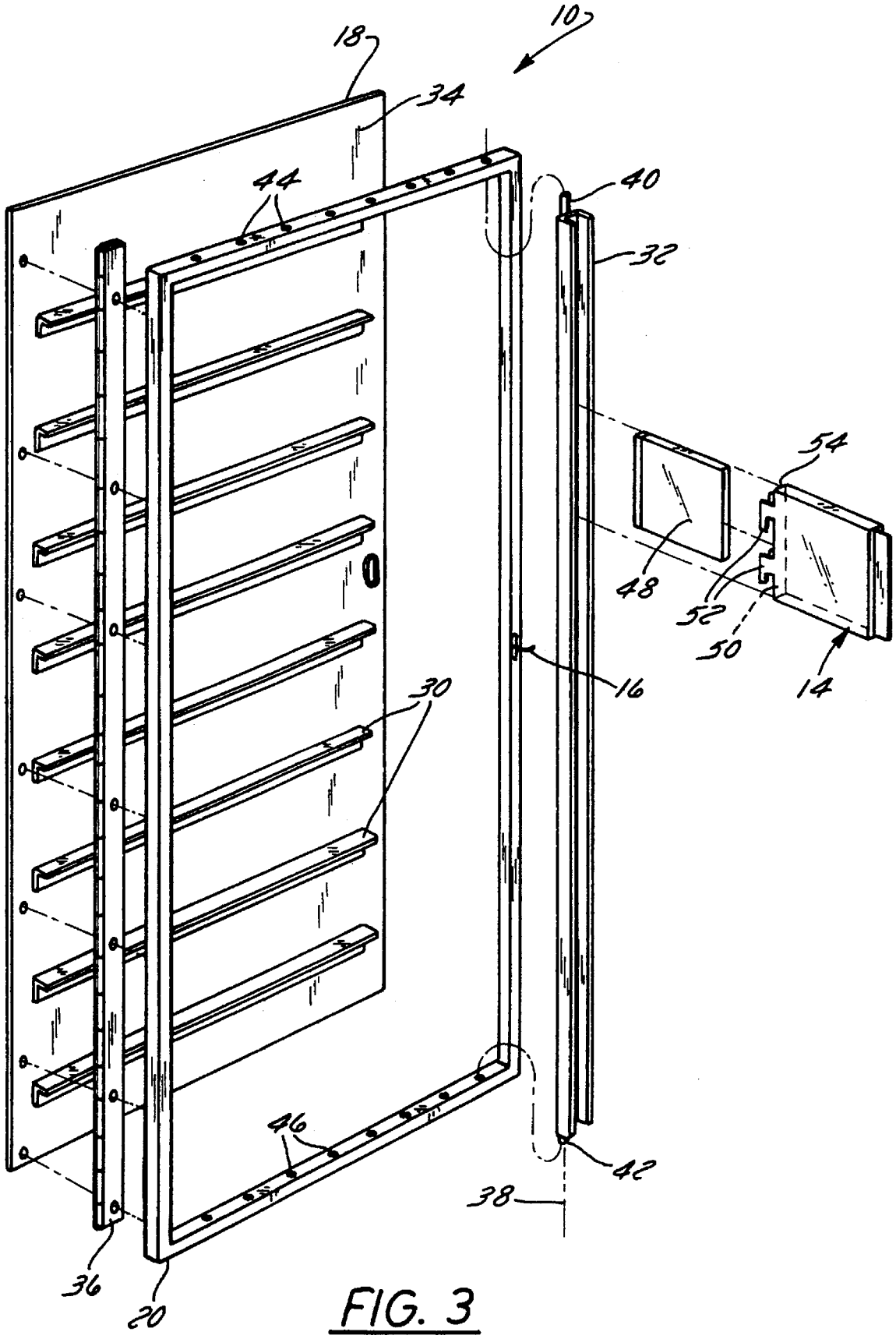
FIG. 3 is an exploded perspective view of a variant of the display system illustrated in FIG. 1 showing the manner in which the various parts are assembled.

In an alternative arrangement of stationary section 18, a flat sheet 34 may be provided without a peripheral frame, as illustrated in FIG. 3. In this arrangement, section 20 is pivotally mounted on sheet 34 by means of a hinge 36, and system 10 is installed by attachment of sheet 34 to a wall or support 26. Locking bars 30 are secured to sheet 34 and cooperate with enclosures 14 to prevent their removal as previously mentioned. In either arrangement, locking bars 30 are preferably metal bars having an L-shaped cross section, fixed to stationary section 18 or sheet 34 (e.g. by tack welding) and extending perpendicularly with respect to support rails 32.

Figure 4:
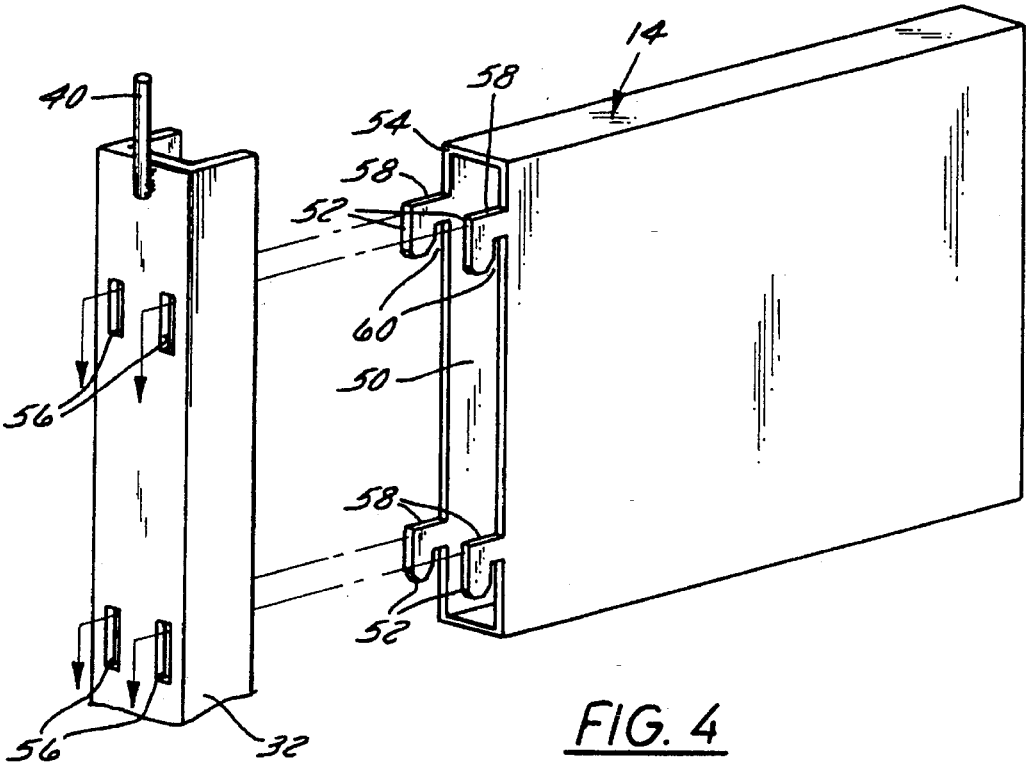
FIG. 4 is an exploded perspective view of a typical display enclosure for use in the display system of FIG. 1, illustrating the manner in which the enclosure is mounted on a rail of the display system.

Support rails 32 are mounted within frame section 20 and are pivotable about a vertical axis 38 such that potential buyers may leaf through columns of merchandise displayed in enclosures 14. In this embodiment, each rail 32 includes upper and lower mounting projections 40 and 42 respectively, and frame section 20 is provided with a series of upper and lower bores 44 and 46 for receiving projections 40 and 42 of a corresponding series of rails 32. This arrangement permits rails 32 to move with frame section 20 into the opened and closed positions and to pivot freely within frame section 20 both in the open and the closed positions.

Where merchandise is positioned in display enclosures 14, each enclosure 14 preferably includes an open end 50 through which merchandise 48 may be positioned within enclosure 14. To facilitate supporting and locking enclosure 14 on rail 32, each enclosure 14 is provided with at least one L-shaped tab 52 and preferably a plurality of L-shaped tabs extending from a rear edge 54 surrounding open end 50. Tabs 52 extend through and mate with corresponding slots 56 in rails 32 (FIG. 4). In this embodiment, each enclosure 14 includes four such tabs arranged in pairs along rear edge 54. Alternatively, each enclosure 14 could include a pair of tabs, arranged one tab on each side of edge 54, or a single tab extending along the upper side of rear edge 54, slots 56 being located and oriented on rails 32 accordingly.

Enclosures 14 are mounted onto rails 32 as illustrated in FIG. 4. Each tab 52 includes an upper interference surface 58 that cooperates with a locking bar 30. An engagement recess 60 is formed between each tab 52 and rear edge 54 of enclosure 14. The height of tabs 52 is slightly inferior to the height of slots 56, so tabs 52 may be aligned with and moved through slots 56 when enclosure 14 is positioned onto rail 32. Moreover, recesses 60 are dimensioned such that, with tabs 50 sufficiently inserted into slots 56, enclosure 14 may be lowered slightly to engage rail 32 within recesses 60. Once enclosure 14 is thus supported on rail 32, open end 50 is covered and closed by rail 32.

Figure 5:
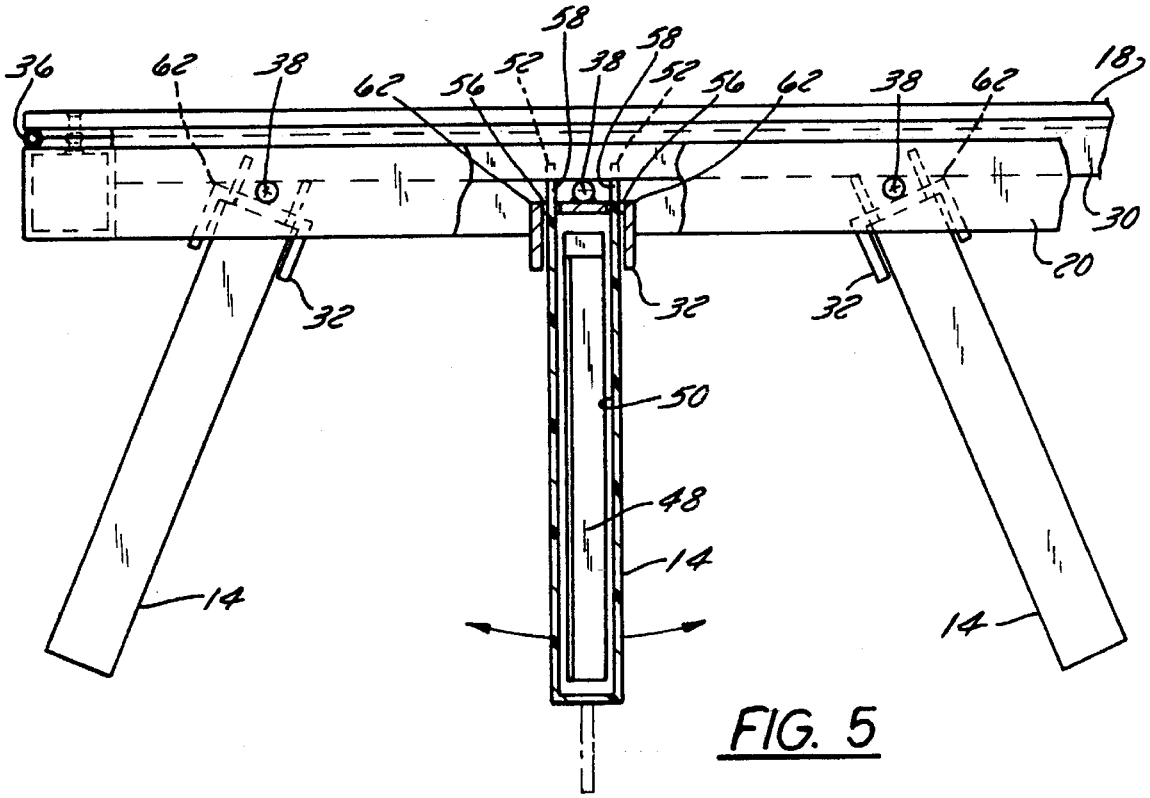
FIG. 5 is a top partial sectional view of the display system of FIG. 1 illustrating the manner in which display enclosures are secured in the display system while remaining pivotable on the support rails.

When display system 10 is in its closed or locked position, locking bars 30 are located slightly above interference surfaces 58 of tabs 52 to effectively prevent removal of enclosures 14 from rails 32. As illustrated in FIG. 5, tabs 52 extend through rails 32 and beneath locking bar 30, so that any attempt to lift and remove enclosure 14 will cause contact between interference surface 58 and locking bar 30 before enclosure 14 can be lifted sufficiently to allow tabs 52 to clear slots 56. Although a locking bar 30 may be provided for each pair of tabs 52 on each enclosure 14, preferably a single locking bar is provided for one pair of tabs 52 on each enclosure 14. In this manner, an enclosure 14 positioned at any location along rail 32 will be effectively secured by a locking bar 30 cooperating with either pair of tabs 52. Moreover, tabs 52 preferably extend sufficiently through rail 32 to maintain this locking relationship while rail 32 is pivoted about axis 38. Rail 32 includes rear corners 62 that contact locking bars 32 to limit the angular displacement of rails 32 and to ensure that at least one tab 52 on each enclosure 14 remains in the interference relationship with a locking bar 32 as described above. As frame section 20 is moved away from stationary section 18 and into its opened or unlocked position, locking bars 30 no longer interfere with tabs 52 and enclosures 14 may be freely removed from rails 32.

Figure 6:
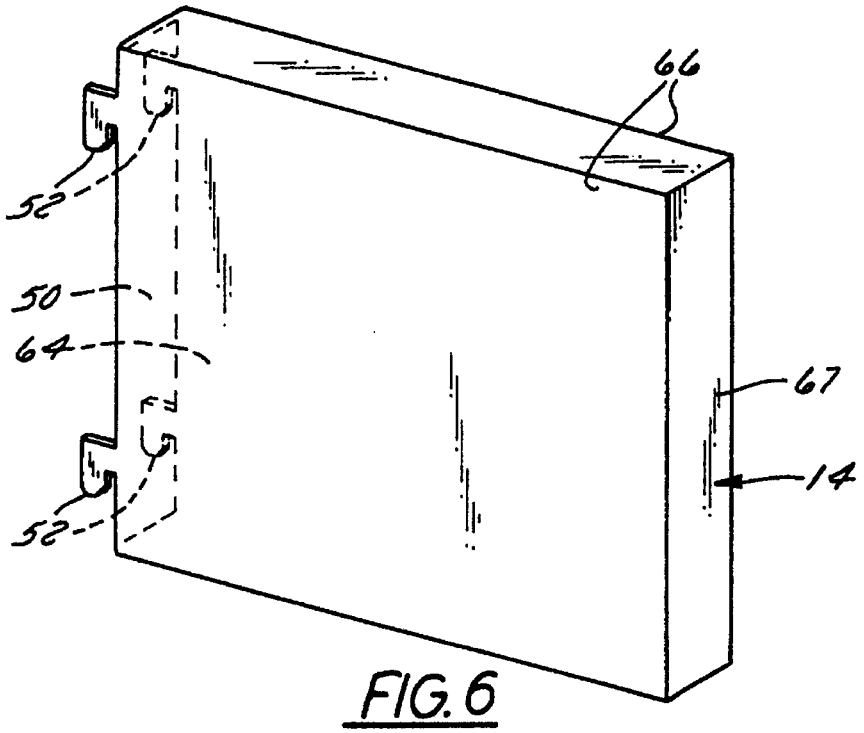
FIG. 6 is a perspective view of a single-piece merchandise display enclosure of the type used in the system illustrated in FIG. 1.
Figure 7:
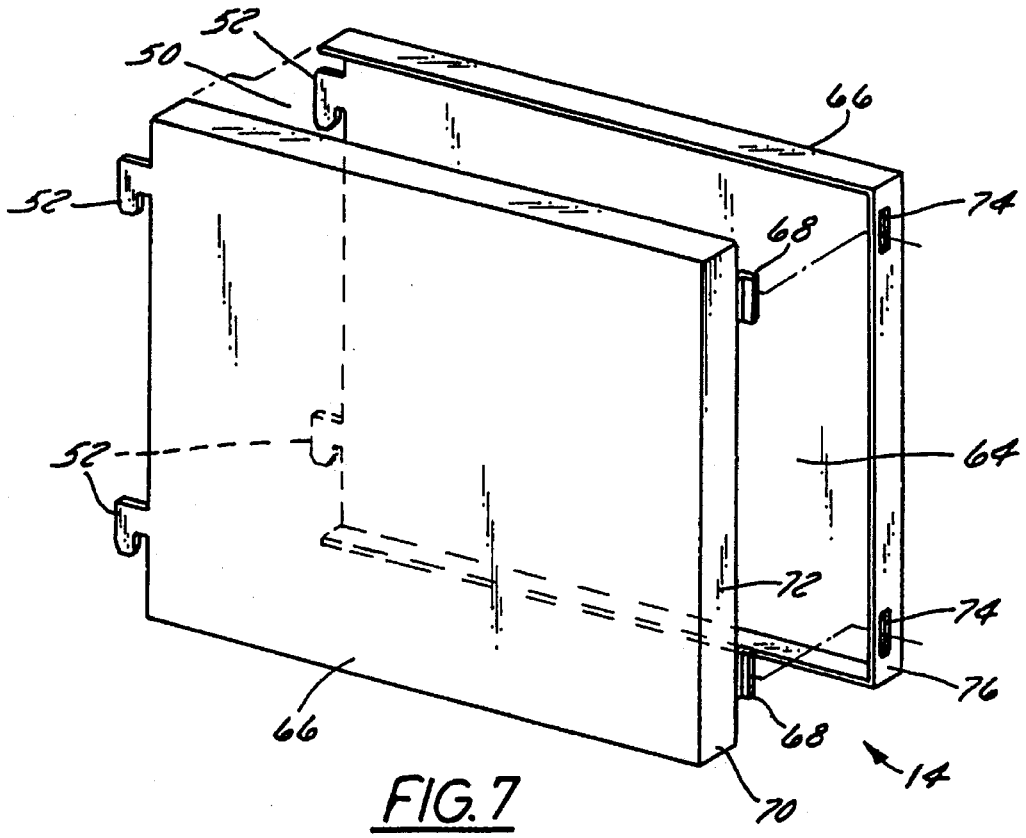
FIG. 7 is an exploded perspective view of a two-piece merchandise display enclosure suitable for use with the system illustrated in FIG. 1.

As illustrated in FIGS. 6 and 7, enclosure 14 may be formed as a single-piece article or in two mating pieces. Either or both configurations may be used simultaneously on display system 10, such as for displaying compact discs or computer software packages of different thicknesses. Where enclosure 14 is a single-piece unit, it is preferably a box structure molded of a clear plastic material enclosing a central display space 64 bounded by side faces 66 spaced apart by an edge face 67. Open end 50 allows merchandise to be inserted into display space 64 as discussed above. Side faces 66 may be continuous sheets of transparent material as illustrated in the FIGURES, or may include at least one aperture for viewing merchandise within enclosure 14. Where enclosure 14 is a two-piece structure, projections 68, preferably having an L-shaped cross section, are provided along a front edge 70 of a first portion 72 of the enclosure, while corresponding apertures 74 are provided in a second portion 76. First and second portions 72 and 76 are assembled by inserting projections 68 into apertures 74 and closing the two portions around display space 64.

Figure 8:
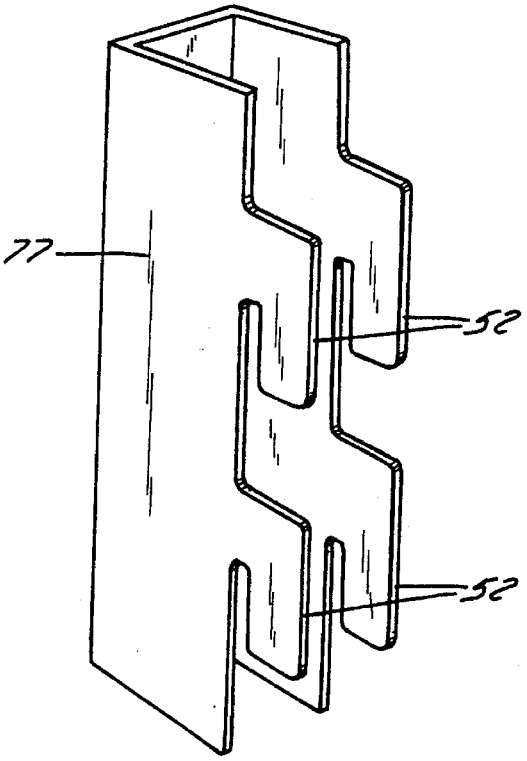
FIG. 8 is a perspective view of an alternative attachment member for mounting merchandise on the display system shown in FIG. 1.

Irregularly-shaped merchandise or merchandise of various sizes may be mounted in display system 10 using an alternative attachment member or bracket 77 as illustrated in FIG. 8. Bracket 77 may be attached to an article of merchandise by any suitable means, such as by a suitable adhesive, strap, pin or the like. Once attached to an article of merchandise, bracket 77 may be supported in display system 10 via locking tabs 52 as described above.

Figure 9:
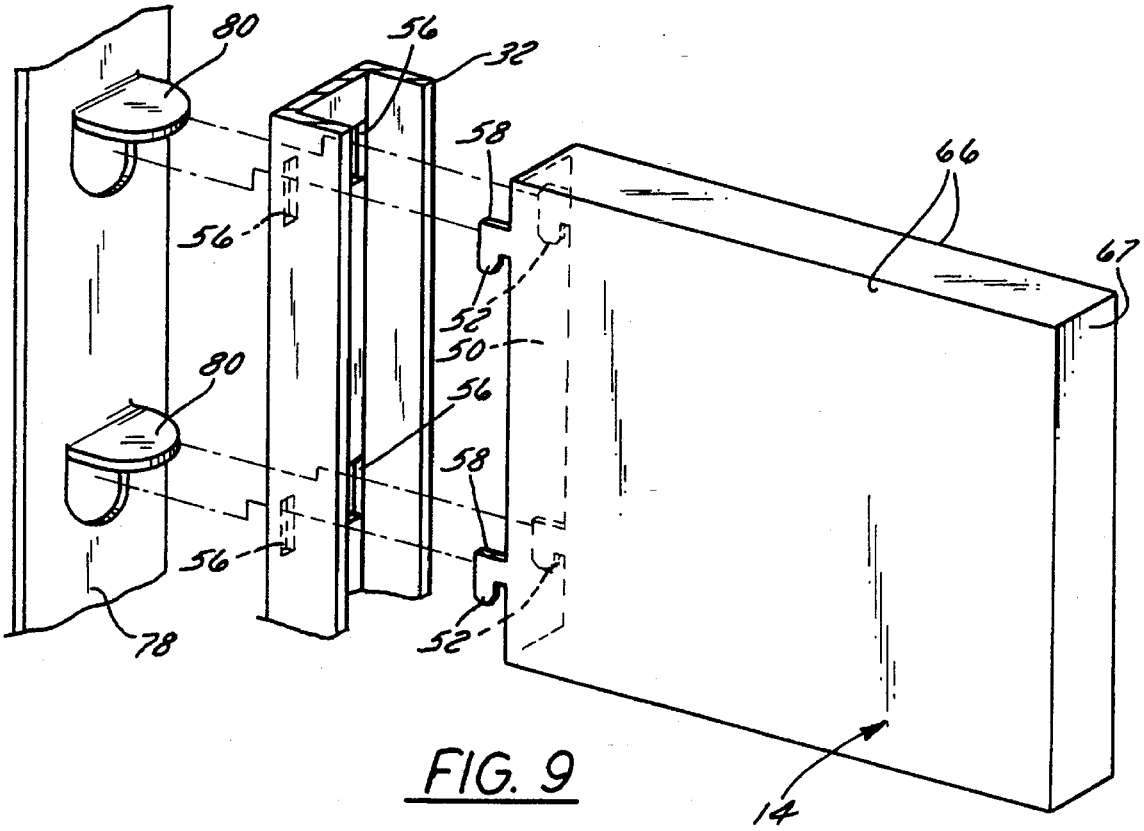
FIG. 9 is a perspective exploded view of a variant of the display system of FIG. 1, illustrating an alternative arrangement of the locking bars.

An alternative configuration for locking bars 30 is illustrated in FIG. 9. In this arrangement, locking bars 30 are fabricated from a flat bar 78 in which a series of flanges 80 are cut and bent to project substantially perpendicularly to bar 78. Flanges 80 are appropriately located to contact interference surfaces 58 of tabs 52 to prevent removal of enclosures 14 in the same manner as previously described. It will be noted that locking bars having this configuration are arranged in stationary section 18 parallel to rails 32 and in locations corresponding to locations of rails 32 in the closed or locked position of display system 10.

Figure 10:
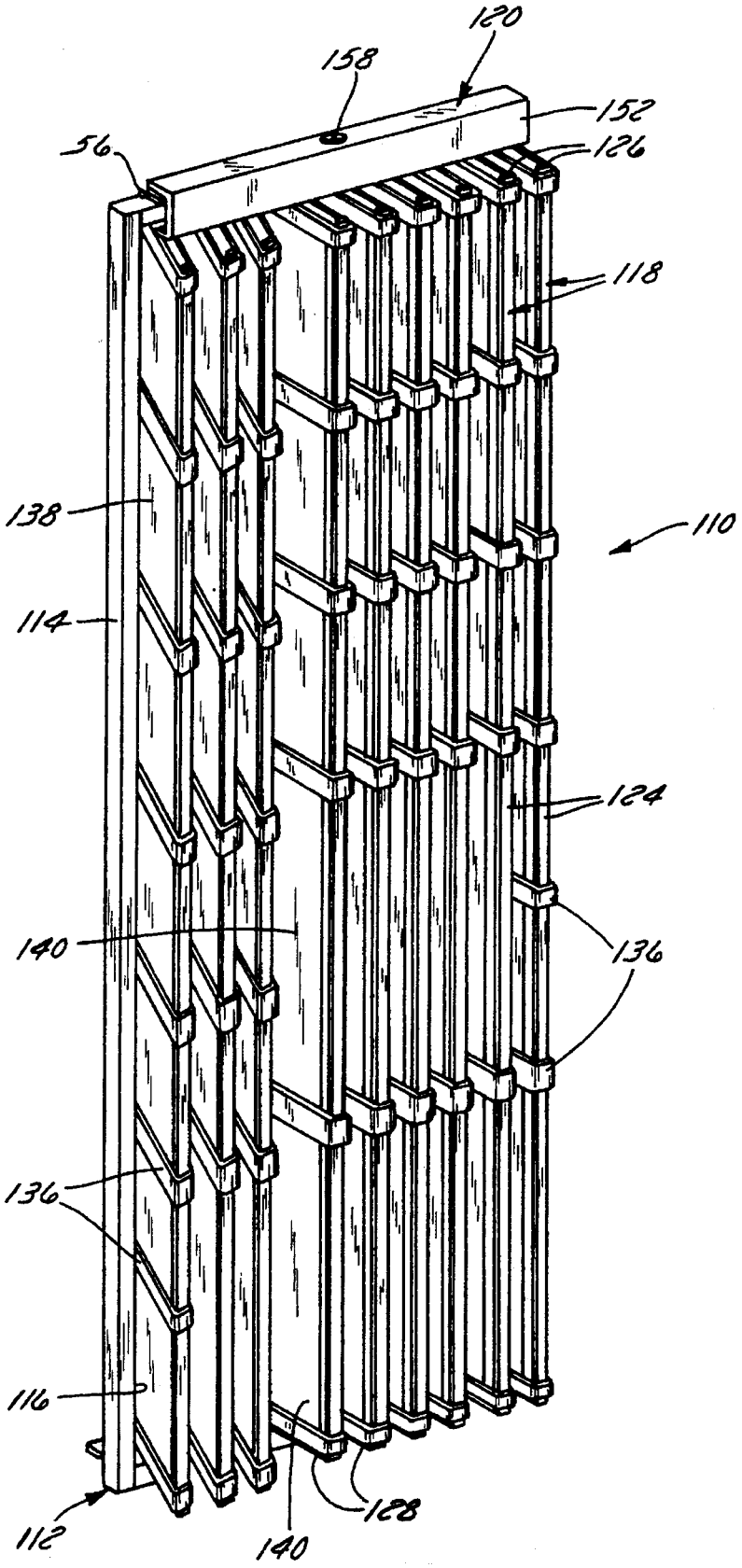
FIG. 10 is a perspective view of a second preferred embodiment of a display system in accordance with the present invention.
Figure 11:
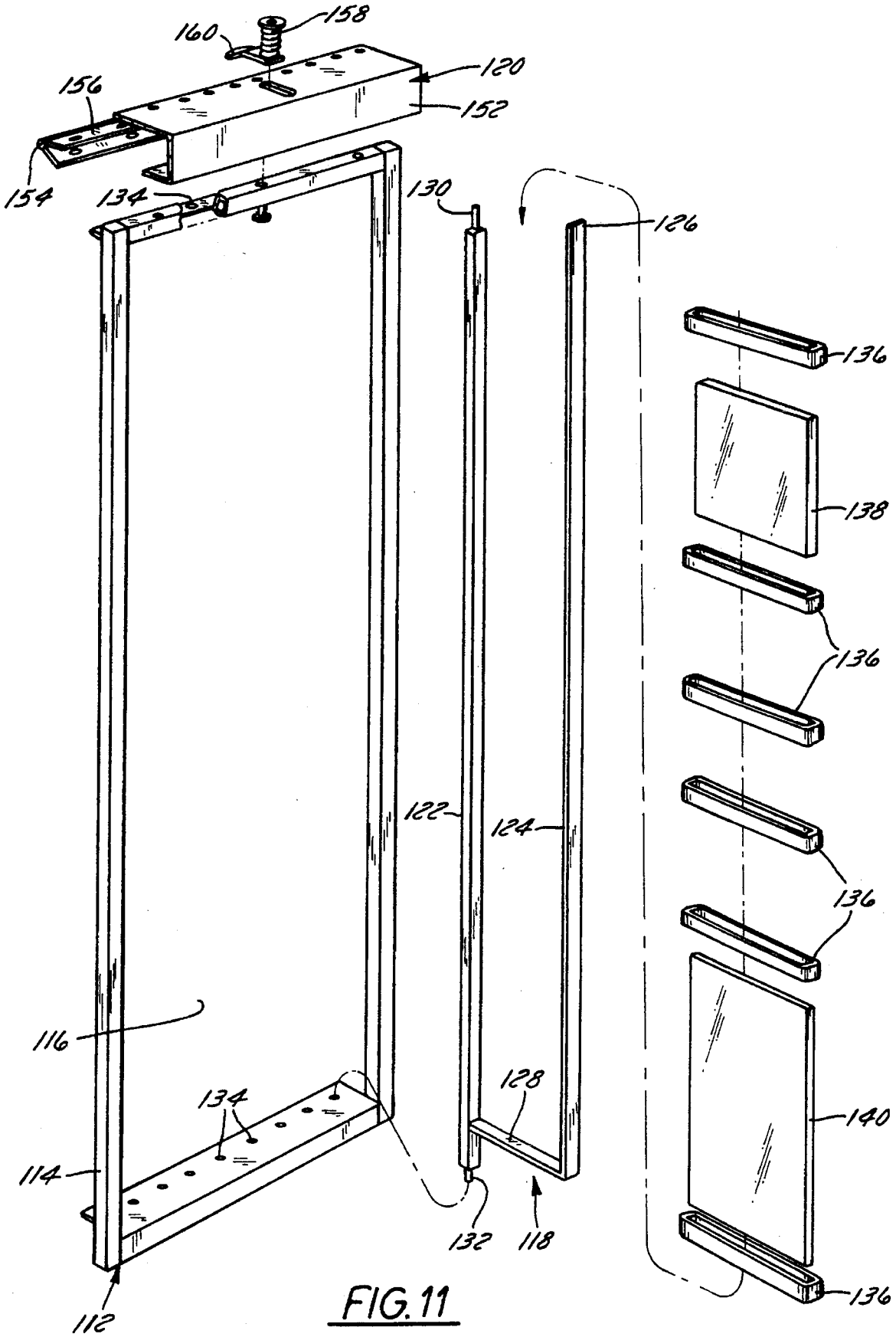
FIG. 11 is an exploded perspective of the display system of FIG. 9 showing the manner in which the various parts are assembled.

A second preferred embodiment of the present display system is illustrated in FIGS. 10 and 11 and designated by the reference numeral 110. In this embodiment, system 110 includes a framework 112 comprising a rectangular frame 114 surrounding a central aperture 116. A series of supports 118 is mounted pivotally within aperture 116 and a locking arrangement 120 is provided atop frame 114 for retaining merchandise within supports 118. Where the security of the merchandise displayed within system 110 is not of concern, such as where system 110 replaces conventional open-access display stands, locking mechanism 120 may be omitted from this embodiment.

As shown in FIG. 11, each support 118 includes a rear support bar 122 and a front support bar 124 extending parallel to rear support bar 122. Front support bar 124 has a free upper end 126 and is coupled to rear support bar 124 by a lower connecting member 128. Rear support bar 122 includes upper and lower pivot pins 130 and 132 that are received in corresponding bores 134 in frame 114 during assembly of display system 110 to permit pivotal movement of support 118, such as for leafing through several columns of merchandise displayed on a series of supports 118. The height of support 118 and the distance between rear support bar 122 and front support bar 124 are a function of the number and overall dimensions of the merchandise packages to be displayed in system 110.

In this embodiment, prior to mounting support 118 in frame 114, separators 136 are slidably engaged on rear and front support bars 122, 124. The number of separators 136 included on each support 118 depends upon the dimensions of the merchandise articles 138 to be displayed and the height of support 118. Generally, a sufficient number of separators 136 is included to permit stacking of merchandise over the entire height of support 118. Where locking mechanism 120 is included in display system 110, it may be necessary to maintain support 118 full to limit the range of sliding movement of separators 136 and thereby prevent removal of merchandise 138. A spacer 140 of appropriate height may be provided for this purpose.

Figure 12:
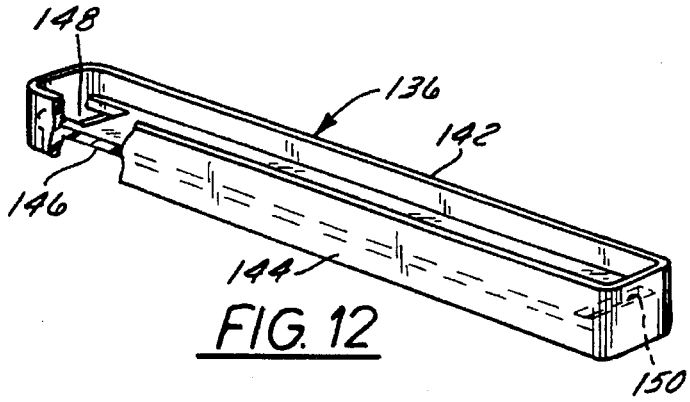
FIG. 12 is a detail view of a separator suitable for use in the display system of FIG. 9.

Separators 136 serve to separate, support, and retain merchandise within support 118. As shown in FIG. 12, separator 136 includes an upper rim or flange 142 and a lower rim or flange 144 forming a peripheral wall. Alternatively, flanges 142, 144 could be replaced by a plurality of upwardly and downwardly-extending projections or similar interrupted flange-type retainers. Upper and lower flanges 142, 144 are separated by a barrier 146 in which apertures 148, 150 are formed to receive rear support bar 122 and front support bar 124 respectively, such that separator 136 may be freely displaced upwardly and downwardly along support 118. Articles of merchandise 138 positioned above and below separator 136 fit within flanges 142, 144 and are separated from one another by barrier 146. To remove an article of merchandise from support 118, the separator 136 immediately above the article to be removed is raised a sufficient distance to permit the article to clear lower flange 144 of the separator and the article is removed laterally.

Figure 13:
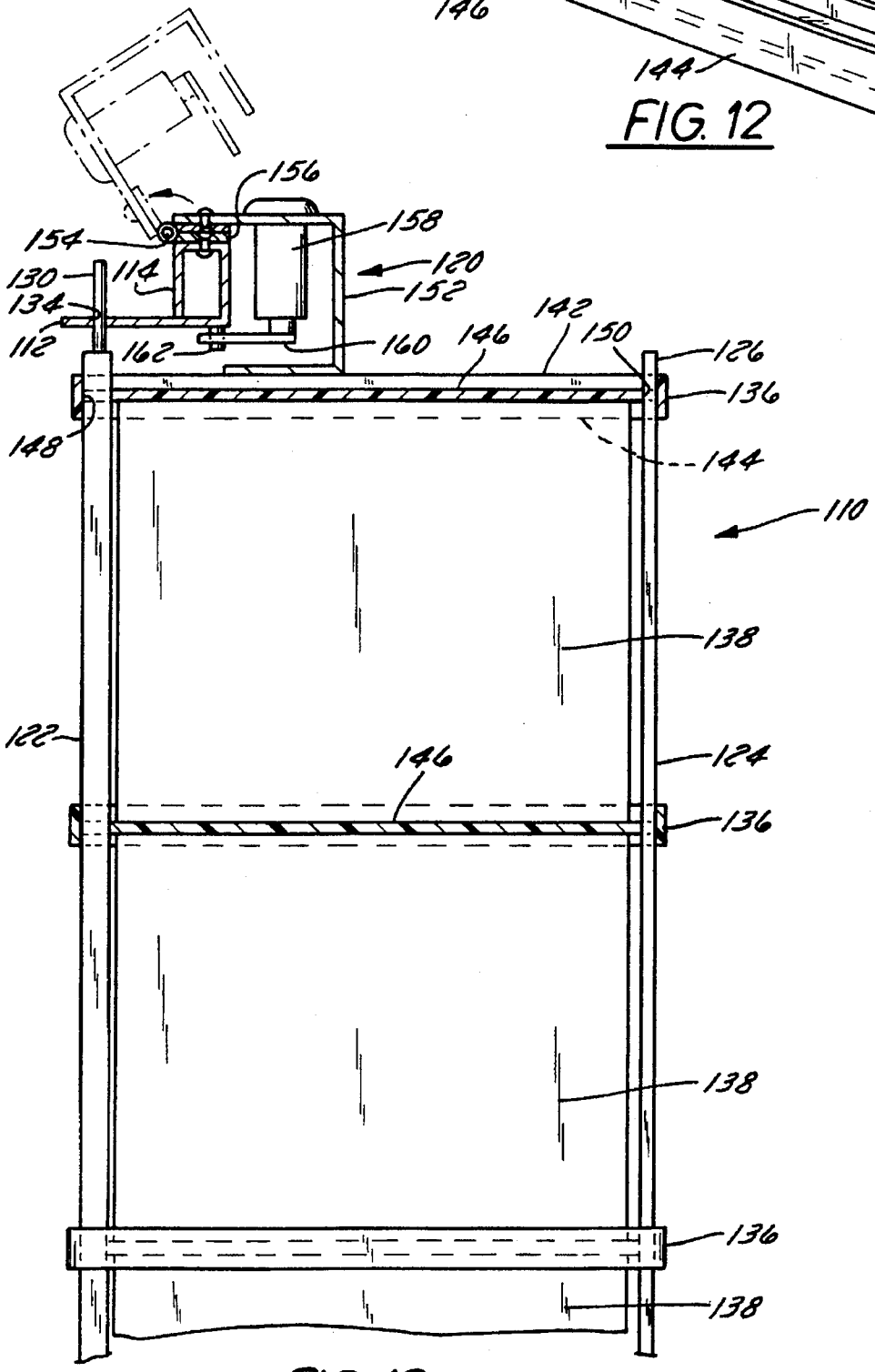
FIG. 13 is a partial sectional view of the display system of FIG. 9, illustrating the cooperation of the locking mechanism with the display rack to prohibit removal of merchandise from the rack.

Display system 110 may be made secure against pilferage by inclusion of locking mechanism 120 as illustrated in FIG. 13. Locking mechanism 120 includes a locking bar 152 mounted atop framework 112 to pivot about a horizontal axis 154. In the presently preferred embodiment, locking bar 152 is joined to frame 114 by a hinge 156 and is pivotable between a lower or locked position and a raised or unlocked position (shown in broken lines in FIG. 13). A lock 158 is provided in locking bar 152 and includes a locking lever 160. Lever 160 swings into and out of engagement with a locking pin 162 on frame 114 as lock 158 is locked and unlocked. In the locked position, locking bar 152 forms an upper stop for the column of separators 136, merchandise 138 and any spacers 140 positioned on support 118, effectively limiting movement of any separator 136 to a distance insufficient to permit removal of merchandise 138. In the unlocked position, merchandise 138 may be freely removed as discussed above.

While the invention is susceptible to various modifications and alternative forms, specific embodiments have been shown and described by way of example in the foregoing drawings and description. However, it should be understood that the invention is not intended to be limited to the particular forms disclosed. Rather, the invention is intended to cover all modifications, equivalents and alternatives falling within the spirit and scope of the invention as defined by the appended claims.

I claim:

1. A merchandise display system comprising a framework including a support member and a locking member, the support member being adapted to receive at least one locking tab of an attachment member associated with an article of merchandise for supporting the article of merchandise for display on the support member, the support member including a pivot axis and being movable about the pivot axis, the locking member being adapted to contact the locking tab to prevent removal of the merchandise from the support member when the locking member is in a first position with respect to the locking tab, the locking tab being movable with respect to the locking member to avoid contact between the tab and the locking member to permit removal of the merchandise when the locking member is in a second position with respect to the locking tab.

2. A merchandise display system as recited in claim 1 wherein the support member is a rail and includes at least one aperture for receiving a corresponding locking tab of an attachment member.

3. A merchandise display system as recited in claim 1 further comprising an attachment member for attachment to an article of merchandise, the attachment member including at least one locking tab configured to releasably engage a corresponding opening in the support member to retain the article of merchandise on the support member.

4. A merchandise display system as recited in claim 1 further comprising an attachment member for mounting an article of merchandise to the support member, the attachment member including an enclosure having an outside wall defining an internal display space suitable for displaying merchandise and at least one locking tab extending from the outside wall of the enclosure, the locking tab being configured to releasably engage a corresponding opening in the support member to retain the article of merchandise on the support member.

5. A merchandise display system as recited in claim 4 wherein the enclosure includes at least one wall portion permitting viewing of merchandise positioned in the internal display space.

6. A merchandise display system as recited in claim 4 wherein the enclosure includes an open end for positioning merchandise in the internal display space.

7. A merchandise display system as recited in claim 4 wherein the enclosure includes two substantially planar side walls, each side wall including at least one locking tab formed integrally therewith.

8. A merchandise display system as recited in claim 4 wherein the enclosure includes a first portion having at least one locking tab, and a second portion adapted to releasably engage the first portion to define the internal display space.

9. A merchandise system comprising:

a locking section including a plurality of locking bars, the locking bars being mounted to the locking section in substantially parallel relation;

a display section including a support structure adapted to receive a plurality of removable display enclosures, the display section being coupled to the locking section and moveable with respect to the locking section between a closed position and an open position; and at least one removable display enclosure including an internal display space and a locking tab, the locking tab being suitably configured to cooperate with the support structure to releasably engage the display enclosure on the support structure;

wherein each locking bar is adapted to contact a locking tab of at least one display enclosure to prevent removal of the display enclosure when the display section is in the closed position and to permit removal of the display enclosure when the display section is in the open position.

10. A merchandise display system as recited in claim 9 wherein the display section is pivotally mounted to the locking section and is pivotable between the closed position and the open position.

11. A merchandise display system as recited in claim 9 wherein each enclosure includes an open end for inserting merchandise into the internal display space and at least one wall portion adapted to permit viewing of merchandise inserted in the internal display space.

12. A merchandise display system as recited in claim 9 wherein the support structure includes a display frame and a plurality of display rails, the display rails being mounted substantially parallel to one another in the display frame.

13. A merchandise display system as recited in claim 12 wherein the locking bars and the display rails extend in the same direction.

14. A merchandise display system as recited in claim 12 wherein the locking bars extend in a first direction in the locking frame, and the display rails extend in a second direction substantially perpendicular to the first direction in the display frame.

15. A merchandise display system as recited in claim 12 wherein each display rail has a longitudinal axis and is mounted in the display frame pivotally about the longitudinal axis.

16. A merchandise display system as recited in claim 12 wherein each display rail includes a first and a second abutment surface, at least one locking bar cooperating with the first abutment surface of each display rail to limit pivotal movement of the respective display rail in a first direction, and at least one locking bar cooperating with the second abutment surface of each display rail to limit pivotal movement of the respective display rail in a second direction.

17. A merchandise display system comprising:

a frame;

at least one display rack pivotally mounted on the frame, the at least one display rack having first and second side members coupled to one another and extending substantially vertically in parallel spaced-apart relation to define a display space, the first and second side members being joined to one another by a connecting member extending therebetween; and at least one separator slidably coupled intermediate the first and second side members, the separator having retaining means for engaging and retaining merchandise positioned intermediate the side members.

18. A merchandise display system as recited in claim 17 further comprising a locking device positioned atop the frame and moveable between a locked position wherein the locking device limits sliding movement of merchandise positioned intermediate the side members and an unlocked position wherein the locking device permits sliding movement of merchandise for removal.

19. A merchandise display system as recited in claim 18 wherein the display rack is pivotally mounted on the frame.

20. A merchandise display system as recited in claim 18 wherein the separator includes a first aperture for receiving the first side member and a second aperture for receiving the second side member.

21. A merchandise display system as recited in claim 18 wherein the retaining means includes a continuous peripheral flange.

22. A merchandise display system as recited in claim 18 wherein the retaining means includes a plurality of upwardly extending projections and a plurality of downwardly extending projections.

23. A merchandise display system as recited in claim 18 wherein the separator includes a barrier for separating merchandise positioned above the separator from merchandise positioned below the separator.

24. A merchandise display system comprising:

a locking section including a plurality of locking bars, the locking bars being mounted to the locking section in substantially parallel relation;

a display section including a support structure adapted to receive a plurality of removable display enclosures, the display section being coupled to the locking section and moveable with respect to the locking section between a closed position and an open position; and a plurality of display enclosures, each display enclosure including an internal display space and a locking tab, the locking tab being suitably configured to cooperate with the support structure to releasably engage the display enclosure on the support structure;

wherein each locking bar is adapted to cooperate with a locking tab of at least one display enclosure to prevent removal of the display enclosure when the display section is in the closed position and to permit removal of the display enclosure when the display section is in the open position;

wherein the support structure includes a display frame and a plurality of display rails, the display rails being mounted substantially parallel to one another in the display frame; and wherein the locking bars and the display rails extend in the same direction.

* * * * *